US005660466A

United States Patent [19]

Hopson et al.

[11] Patent Number: 5,660,466

[45] Date of Patent: Aug. 26, 1997

[54] APPARATUS AND METHOD FOR UNIFORMLY WETTING HARD-TO-WET POWDERS

[75] Inventors: Brian Cameron Hopson; Peter Croft, both of Suffolk, Va.; Joel Steven Jordan, Monument, Colo.; Gerald Muir Rott, Bakersfield, Calif.; Joseph Vincent Tinto, Chesapeake, Va.

[73] Assignee: Allied Colloids Limited, United Kingdom

[21] Appl. No.: 446,845

[22] PCT Filed: Feb. 23, 1994

[86] PCT No.: PCT/GB94/00358

§ 371 Date: Oct. 12, 1995

§ 102(e) Date: Oct. 12, 1995

[87] PCT Pub. No.: WO94/19095

PCT Pub. Date: Sep. 1, 1994

Related U.S. Application Data

[63] Continuation-in-part of Ser. No. 25,360, Feb. 26, 1993, abandoned.

[51] Int. Cl.[6] ..... B01F 5/20; B01F 15/02

[52] U.S. Cl. ..... 366/137.1; 366/138; 366/173.2; 366/178.2; 366/347; 239/113; 239/424.5; 239/425.5

[58] Field of Search ..... 366/9, 137.1, 138, 366/167.1, 173.1, 173.2, 178.1–178.3, 181.6, 341, 347; 239/113, 420, 422, 423–424.5, 425.5, 428.5, 430

[56] References Cited

U.S. PATENT DOCUMENTS

| | | | |
|---|---|---|---|
| 2,224,355 | 12/1940 | Moller | 239/424 X |
| 2,746,728 | 5/1956 | Pomerleau | 366/137.1 X |
| 3,029,069 | 4/1962 | Cummings . | |
| 3,164,443 | 1/1965 | Watson . | |
| 3,542,342 | 11/1970 | Barron | 366/178.1 |
| 3,741,533 | 6/1973 | Winn, Jr. | 366/178.3 X |
| 4,086,663 | 4/1978 | Croft . | |
| 4,488,407 | 12/1984 | DeLano . | |
| 4,531,673 | 7/1985 | Holland et al. . | |
| 4,643,582 | 2/1987 | Ricciardi . | |

FOREIGN PATENT DOCUMENTS

| | | |
|---|---|---|
| 459 832 | 6/1926 | Germany . |
| 24 29 393 | 6/1974 | Germany . |
| 26 50 631 | 6/1978 | Germany . |
| 2 067 908 | 1/1980 | United Kingdom . |

*Primary Examiner*—Charles E. Cooley

*Attorney, Agent, or Firm*—Dickstein Shapiro Morin & Oshinsky LLP

[57] ABSTRACT

Apparatus for wetting particulate material comprises a duct 1 that is open at its base 2 and that is provided at its top 3 with a duct inlet 4 defined by inlet walls 5 down which water flows continuously from a weir 6 around the top of the walls. Sprays 19 at or just beneath the duct inlet 4 direct water downwardly so as to wet the particulate material. Preferably the apparatus is used for wetting friable particulate material, in which case the sprays direct water across the path of the downflowing particulate material so as to disintegrate it into individual particles and to wet these. Downflow of air is minimized by providing a cowl 9 over the top of the duct and by feeding the particulate material, generally by a screw feed 13, into a passage that leads from an inlet 15 that is exposed to the atmosphere to an outlet that discharges direct into the duct inlet 4.

18 Claims, 3 Drawing Sheets

APPARATUS AND METHOD FOR UNIFORMLY WETTING HARD-TO-WET POWDERS

CROSS-REFERENCES TO RELATED APPLICATIONS

This application is a national stage application filed under 35 U.S.C. § 371 from International Application No. PCT/GB94/00358, filed Feb. 23, 1994, which is a continuation-in-part of U.S. application Ser. No. 08/025,360, filed Feb. 26, 1993, now abandoned.

BACKGROUND OF THE INVENTION

This invention relates to an apparatus and method for wetting powdered material, especially polymeric powdered material, so as to promote subsequent uniform distribution of the wetted material throughout bulk water.

It is well known that it can be difficult to dissolve water soluble powdered material quickly in water without forming lumps of aggregated partially dissolved material, often called fish-eyes.

Numerous mixing devices have been proposed with the aim of converting dry, substantially friable, particulate material into a uniform dispersion or solution in water.

A successful device is described in U.S. Pat. No. 4,086,663. This involves feeding particulate solids entrained in a stream of air centrally into a duct that is open at its lower end and that is provided with a plurality of sprays around the inlet for the entrained solids. The sprays are arranged to generate a spray of mist particles that substantially fill the duct. The individual polymer particles are wetted substantially individually while they pass down through the duct. They are collected in bulk water at the bottom of thE duct and, since they are individually wetted before they contact the water, they can dissolve or swell in the water rapidly and substantially independently of one another.

Using this system therefore it is necessary that the polymer fed into the duct is in the form of individual particles. Particulate solids still in a friable or loosely aggregated form must be broken into individual particles by entrainment in air before they enter the duct.

Another apparatus that preferably feeds the particulate solids into the device while entrained in air is U.S. Pat. No. 4,390,284. The solids may be fed into the device using a screw feeder. In this, a tangential stream of water is directed helically around a cone shaped inlet into which the entrained stream is directed, so as to wet that cone shaped inlet and prevent build-up of dry material on it. Wetting of the particulate material is substantially carried out by helically arranged jets of water in a cylindrical wetting duct. These jets are arranged to induce a considerable air flow through the cone shaped inlet and wetting duct.

A disadvantage of processes of this type is that they involve a large amount of air being fed into the top of the duct. Although the majority of the polymer particles are wetted while travelling through the duct and are collected in the bulk water beneath the duct, a large amount of air has to escape from the bottom of the duct above the bulk water and there is a risk that this air will carry away from the apparatus polymer particles entrained in the air. The risk is particularly significant for polymer particles that are finer than the majority of the particles for which the apparatus is designed. Accordingly the apparatus has a tendency to allow polymer fines to be blown away from the foot of the duct and this is undesirable, especially when the polymer powder contains a significant proportion of fines.

In U.S. Pat. No. 4,531,673 a polymer is fed by a screw feed into the top of a cone shaped duct and so it might be thought that this would reduce the risk of fines being blown out of the bottom of the duct. However the inlet arrangements at the top of the duct are designed to promote a flow of air being induced into and down the duct as a result of the downwardly directed water sprays. Since the apparatus is designed to induce this air flow, the problem of fines being blown out of the bottom of the duct still occurs.

In U.S. Pat. No. 4,643,582 the powdered material is fed into an upper conical inlet that leads into a cylindrical duct. A stream of water is directed tangentially into the conical inlet so as to flood its surface, and water is also directed tangentially into the cylindrical duct. Pressurised air is forced into an annulus around the conical portion and exits from this annulus into the cylindrical duct, thereby inducing suction into the centre of the conical portion so as to draw the powder into that. The pressurised air again incurs the risk of fines being blown out of the bottom. The use of a tangential water supply to flood the surfaces increases the risk of dry particles being partially dissolved in this excess water while in contact with one another, thus promoting the formation of fish-eyes.

It is an object of the invention to provide a simple apparatus and method for uniformly wetting water soluble or water swellable particulate material so as to permit that material to be dissolved or uniformly dispersed in bulk dilution water with minimum formation of fish-eyes, whilst maintaining a low level of build-up of solid material in the apparatus. It is a further object of the invention to achieve this with minimum escape of particulate fines from the apparatus during use. It is a preferred object of the invention to provide an apparatus and method for doing the above for water soluble or water swellable friable particulate material.

SUMMARY OF THE INVENTION

The invention provides apparatus for uniformly wetting water soluble or water swellable particulate material comprising a substantially vertical wetting duct that is open at its lower end and that has at its upper end a duct inlet that is substantially coaxial with the duct and that is defined by inlet walls, and through which the material can be fed to the duct, and water spray orifices arranged to direct sprays of water downwardly in the wetting duct to wet the particulate material, characterised in that the duct inlet has a radius less than the radius of the duct and the water sprays are positioned substantially around the duct inlet and the apparatus also comprises weir means extending around the top of the inlet walls, and means for providing a substantially continuous flow of water over the weir means and down along substantially the entire exposed surface of the inlet walls.

The invention includes the method of using the apparatus. In use the particulate material is fed by feed means into the duct inlet.

In order to minimise the risk of the particulate material adhering to the walls of the inlet, these walls are continuously flushed by water overflowing the weir means that extend around the top of the walls. As a result of flushing the walls by water that overflows a weir extending around substantially the entire length of the top of the walls it is easily possible to keep the walls substantially entirely free of accumulated particulate material even though the amount of water flowing down the walls can be rather small. This is in contrast to the known methods described above wherein a relatively large amount of water has to be applied tangentially with the intention of trying to wash the entire wall surface. The most convenient way of providing a substantially continuous flow of water over the weir means comprises providing an annular vessel surrounding the duct inlet and ducting for continuous supplies of water to the annular vessel. By adjusting the rate of supply of water through that ducting, the rate of flow of water over the weir and down the inlet walls can be controlled.

The particulate materials for which the invention is useful are generally polymeric materials. They can be water-soluble polymers, in which event the wetted polymer particles will subsequently be added to water to form solution, or they can be water-swellable but water-insoluble particles in which event the wetted particles will form a uniform suspension upon addition to water.

The above apparatus and method are useful for uniformly wetting particulate material introduced into the duct wholly or mainly in the form of individual particles, for example as in U.S. Pat. No. 4,086,663, discussed above.

However, the apparatus and process of the invention are preferably used for uniformly wetting water soluble or water swellable friable particulate material. By referring to friable particulate materials we mean materials which are formed of particles which have tended to clump together in loose agglomerates and which remain as agglomerates unless steps are taken to separate them.

In an apparatus useful for this purpose the water spray orifices positioned substantially around the duct inlet are preferably arranged to direct sprays of water downwardly and substantially across the axis of the duct and thereby to disintegrate into substantially independent particles friable particulate material falling through the duct from the inlet and to wet the substantially independent particles.

In known techniques, the particulate material is often introduced while entrained in air, in which event initially friable particulate material is separated into substantially independent particles by the air entrainment. However this necessitates the flow of substantial amounts of air through the duct, and this can result in fines or other material being blown out of the duct. The invention avoids this. In this preferred aspect of the invention, the particulate material is fed into the apparatus while still in its friable or loosely agglomerated form. It may be carried into the apparatus by any suitable carrier on which friable material may be carried, such as a screw feed or a belt conveyor, resulting inevitably in loose agglomeration of the particles as they enter the apparatus.

The water spray orifices are positioned substantially around the duct inlet and so can be located at a level that is either slightly below or at the lowermost part of the duct inlet or can be positioned around the sides of the duct inlet or even slightly above the duct inlet. Preferably however they are positioned around the lowermost part of the duct inlet or slightly below it, e.g. 1 to 5 cm below it. Conveniently the sprays extend from an annular chamber to which pressurised water is applied and which has an outer diameter substantially the same as the diameter of the duct. Thus the sprays are preferably located around an annulus that has an internal radius that is at least half, and preferably at least two-thirds, of the radius of the duct.

The sprays serve two purposes. One purpose is to disintegrate the friable material used in the preferred aspect of the invention substantially into individual particles. Accordingly they must have sufficient power to do this and must be directed across the general line of travel of the particulate material. The other purpose of the sprays is to provide a reasonably uniform distribution of water droplets falling throughout the entire duct so as to maximise the contact of the polymer particles with water droplets while the particles are falling through the duct. This latter purpose is fulfilled in all forms of apparatus and all methods according to the invention.

The downward flow of the water sprays will tend to induce a downflow of air through the duct. In order to control and generally minimise the induced air flow through the duct the apparatus may include a cowl that substantially entirely encloses the top of the wetting duct. The cowl should include an aperture to permit the provision of feed means for feeding the particulate, preferably friable, material to the duct inlet from outside the cowl. The cowl should also include air inlet means. The aperture referred to above may also serve as air inlet means. Preferably the air inlet means are substantially coaxial with the duct. The air inlet means may include a passage which terminates above or inside the duct inlet.

Preferably the feed means discharge direct into this passage. The feed means, preferably a conveyer feed means when the material fed is friable particulate material, may lead from outside the cowl through the aperture into the cowl so as to discharge the particulate material above the duct inlet. In such a case the feed means terminate within the cowl below the air inlet and above the duct inlet. The air inlet means are in such a case generally positioned in the top surface of the cowl, separate from the aperture. The passage is also entirely within the cowl.

Preferably however the feed means are entirely outside the cowl and discharge into the air passage which leads from outside the cowl through the aperture to the duct inlet. In the latter case air turbulence and build-up of particulate material within the cowl are reduced.

The flow of air from the air inlet will tend to carry the particulate material as a stream into the duct inlet. This is particularly useful when the particulate material is not fed entrained in air but is fed into the apparatus in its friable form.

When the feed means terminate within the cowl, the air inlet means may merely be an aperture in the top of the cowl. However they may alternatively be adjustable air inlet means for controlling the amount of air that can be induced to flow into the upper end of the wetting duct. When the feed means terminate outside the cowl at an air passage leading into the cowl the top of the air passage may merely be an aperture or may be adjustable. In some embodiments adjustable air inlet means may be desirable; in others the overall design may render it unnecessary.

In the preferred aspect of the invention the air passage has an air inlet that is exposed to the atmosphere and a side feed position for receiving a feed of friable particulate material and leads to an outlet that discharges into the duct inlet. When the material fed is not in the friable form the material may be fed entrained in air. In such a case the air inlet means will generally not simply be exposed to the atmosphere but will lead from air entrainment means.

The air passage outlet is preferably of smaller diameter than the duct inlet but can be substantially coextensive with, and positioned above, it if desired. The spacing between the passage outlet and the top of the duct inlet (generally the weir means) is preferably made as small as conveniently possible in order to minimise the amount of air induced by the sprays to flow in through this spacing, especially when there is no cowl. When the passage outlet is of smaller diameter than the duct inlet it preferably extends into the duct inlet. This assists in directing and accelerating the particulate material into the duct from the passage outlet.

There may also be provided if desired openings in the upper end of the wall of the wetting duct. These are preferably positioned substantially at the same height as the sprays. They may be substantially equally spaced around the wetting duct wall. Preferably each hole is positioned between two adjacent water spray orifices. The holes allow air to be drawn indirectly into the duct to compensate for the air downflow effect of the water sprays and reduce turbulence and build-up of particulate material in the upper end of the duct. Instead of being in the walls of the duct, they may, less preferably be between the duct and cowl or even in the lower part of the cowl.

The preferred particulate materials are water soluble polymers having a particle size with at least 90%, and usually at least 99%, by weight in the range 20 to 1000 μm. Because the invention allows minimisation of the amount of air flowing through the duct and the risk of fines blowing out of the bottom of the duct, the invention is of particular value when the particulate material includes at least 2%, and often at least 5% by weight of material having a particle size in the range 20 to 100 μm, often 20 to 70 μm. The amount of these "fines" can be as high as, for instance, 30% by weight but is preferably below 15 or 20% by weight.

At least 80%, and usually at least 90%, by weight of the particulate material usually has a particle size below 700 μm, frequently below 400 μm.

The particulate material can be a natural polymer such as a starch or cellulose but preferably is a synthetic polymer made by polymerisation of water-soluble monomers, optionally with a cross-linking agent if the polymer is to be swellable and insoluble. The monomers can typically be acrylamide or other non-ionic monomers, sodium acrylate or other anionic monomers, and dialkylaminoalkyl(meth)-acrylate or -acrylamide acid addition or quaternary salts or other cationic monomers.

DESCRIPTION OF THE DRAWINGS

The invention is illustrated in the accompanying drawings (which are not to scale) wherein.

DESCRIPTION OF THE PREFERRED EMBODIMENTS

Figure 1:
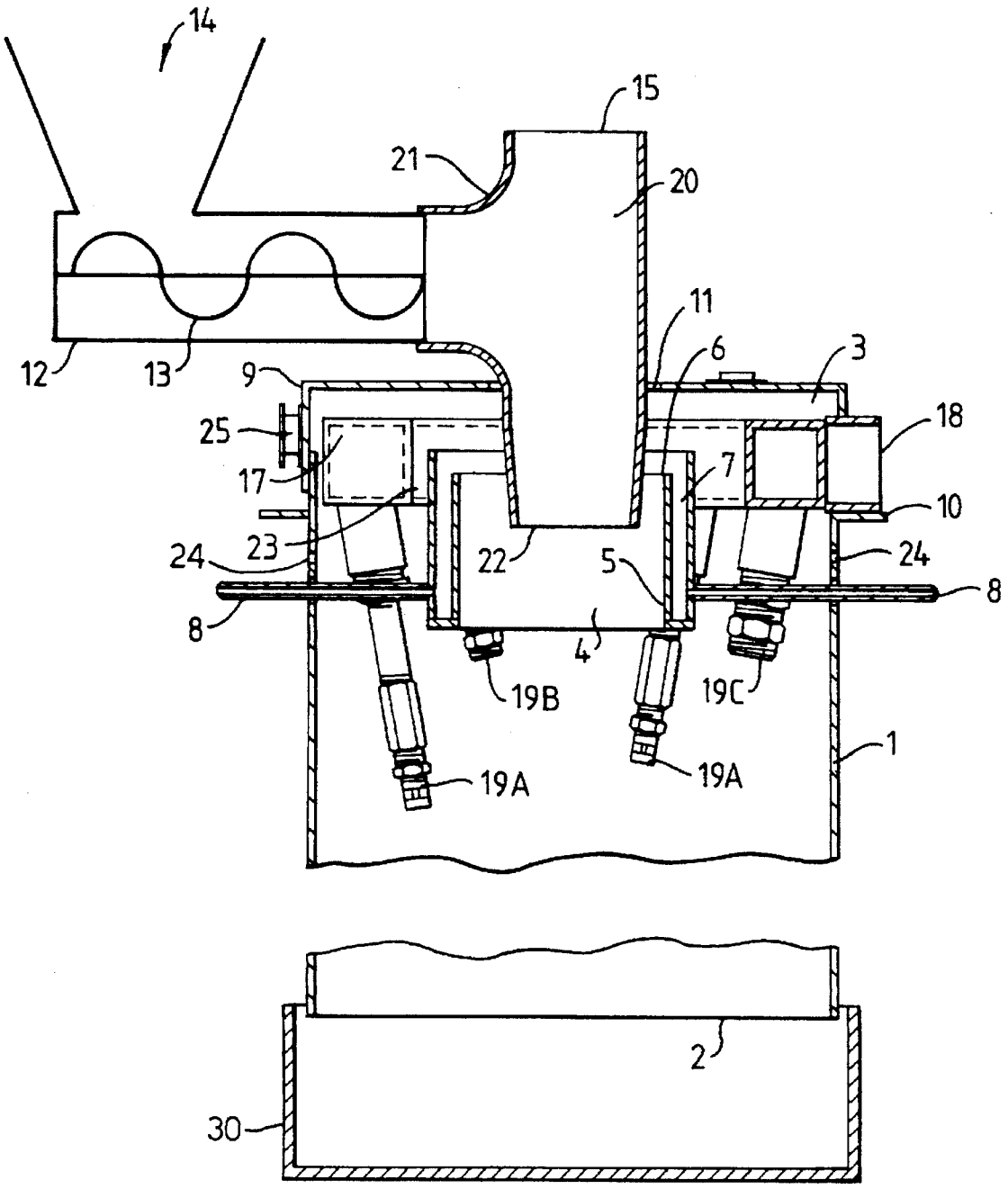
FIG. 1 is a vertical cross-section through one form of apparatus according to the invention.
Figure 2:
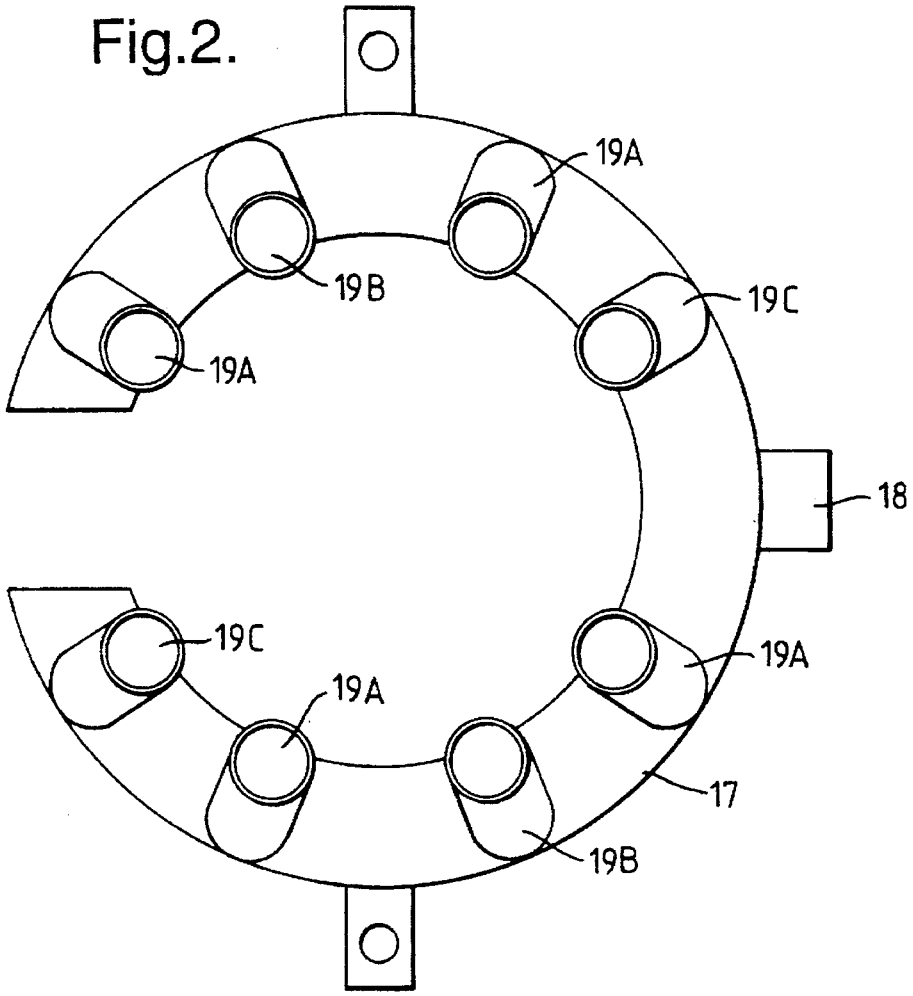
FIG. 2 is a plan view from below of the assembly of spray nozzles shown in FIG. 1.
Figure 3:
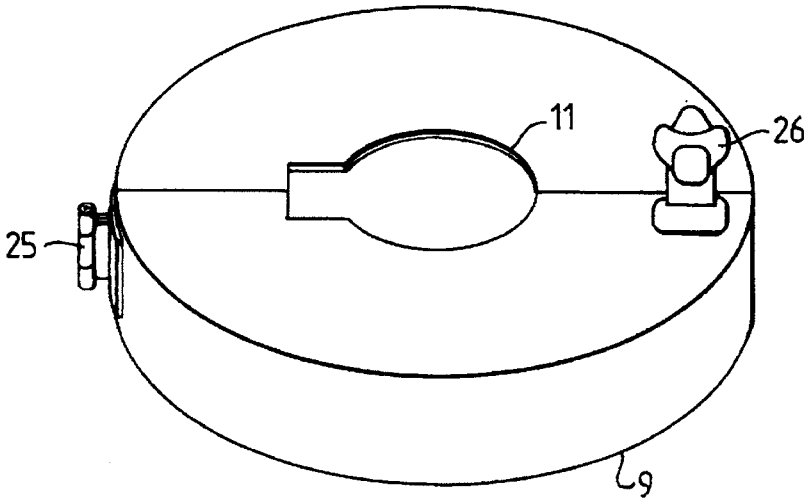
FIG. 3 is a perspective view, part broken away, of the cowl.

One typical apparatus, for wetting friable particulate material, is substantially cylindrical and is shown in FIGS. 1 to 3 in which the duct 1 is shown as having an open lower end 2 and an upper end 3. A duct inlet 4 is positioned coaxial with the duct and is formed of cylindrical inlet wall 5 having an upper edge 6 that serves as a weir from an annular water chamber 7 that is supplied with water through pipes 8. The film of water that can be caused to flow continuously down the walls 5 prevents powder sticking to the walls even though some spray droplets may enter the inlet from below.

A cowl 9 rests on lugs 10 and makes a reasonably tight fit around the top of the duct 3 so as to minimise the amount of air that can be drawn in around the base of the walls of the cowl. The cowl is provided with an aperture 11 to permit the insertion of an air passage 20 which has at its top end an air inlet 15. As shown in FIG. 3, the cowl may comprise two halves that are hinged at a hinge 25 at the side and that are clipped together by a clip 26 to form the complete cowl.

The duct inlet 4 and the air inlet 15 are substantially coaxial with the duct 1 and are interconnected by the air passage 20 which terminates at a passage outlet 22 inside the duct inlet 4. The passage 20 has a smaller diameter than the duct 4. The apparatus is provided with a conveyer 12 that is typically a screw feed conveyer 13 and that leads from a hopper or other suitable store 14. The conveyor 12 is positioned to discharge loosely agglomerated powder from the hopper 14 into a side feed T-piece 21 in the duct 20 at a position between the air inlet 15 and duct inlet 4. As a result the powdered material is carried by a controlled airstream travelling from the inlet 15 to the inlet 4 and which is induced by the sprays. The annulus 23 around the chamber 7 is open, but since the passage 20 discharges direct into the inlet 4 very little powder enters this annulus and since the cowl is substantially closed around the passage 20 only a small amount of air flow is induced down through this annulus.

An annular chamber 17 surrounds the bottom of the inlet duct 4 and is provided with water supply pipes 18 by which pressurised water can be forced into the annular chamber. Spray jets 19 (shown as 19A, 19B and 19C and discussed in more detail below) are arranged around this annulus in such a way that they all point downwardly and inwardly. Their angle to the vertical is generally in the range 5° to 30°, typically 8° to 15 °. Although it is convenient for all the spray jets to be similarly inclined so as to define a cone, as illustrated, it is also possible for the jets to be mounted at different angles, for instance with some of the jets being mounted at an angle of 5° to 20 ° and some of the jets being mounted so as to make a greater angle with the vertical, for instance 15° to 40°.

In order that the jets break up the downflowing particulate material is preferred that they operate at a high pressure, typically in the range $1.03\times10^5$ to $4.14\times10^5$ Pa (15 to 60 psi), preferably $1.38\times10^5$ to $2.76\times10^5$ Pa or $4.14\times10^5$ Pa (20 to 40 psi or 60 psi), and provide a cone angle at each jet of from 10° to 100°, preferably 10° to 45°. Preferred jets are sold by Spraying Systems under the trade names Floodjet and Fulljet. Such jets are preferably mounted at centre spacings of 3 to 15 cm, often around 6 cm. Preferably some of the sprays have a cone angle of 30° to 90° or 100° and some have an angle of 100° to 140°. The different sprays are preferably substantially uniformly distributed around the duct. Further sprays can be positioned elsewhere in the duct, but this is generally undesirable.

Holes 24 are provided in the wall of the duct 1 just below the lugs 10. The holes 24 are equally spaced with each one being placed between a pair of spray jets 19. The presence of these holes reduces turbulent air flow in the upper end oft he duct 1 and reduces polymer build up in the apparatus.

The interior surfaces of the duct 1, duct inlet 4, spray jets 19 and side feed T-piece 21 are coated with non-stick material. This facilitates cleaning of the apparatus and contributes to the reduction of polymer build up on the interior surface of the side feed T-piece 21.

On the exterior surface of the side feed T-piece there are provided heating elements. This reduces condensation in this part of the apparatus.

The duct 1 typically has a radius of from 9 to 15 cm, often around 10 to 60 cm, generally 10 to 15 cm and a length below the spray orifices of from 22 to 200 cm, often 22 to 30 cm. The length above the spray orifices is typically 7 to 15 cm, often 9 to 15 cm. The ratio of the diameter to the length is often from 1:2 to 1:5. The duct inlet 4 typically has a radius of from 3 to 5 cm and a length above the spray orifices of from 1 to 5 cm. The ratio of the diameter to the length is often from 1:1 to 1:3.

FIG. 2 shows a plan view of the assembly of spray nozzles. For ease of disassembly and cleaning of the apparatus the annular chamber 17 may be provided as an incomplete annulus as shown. Thus, the head can easily be removed for cleaning by unclipping the two halves of the cowl, opening it out and sliding the cowl away from the duct, and sliding the chamber and sprays away from the duct.

Figure 4:
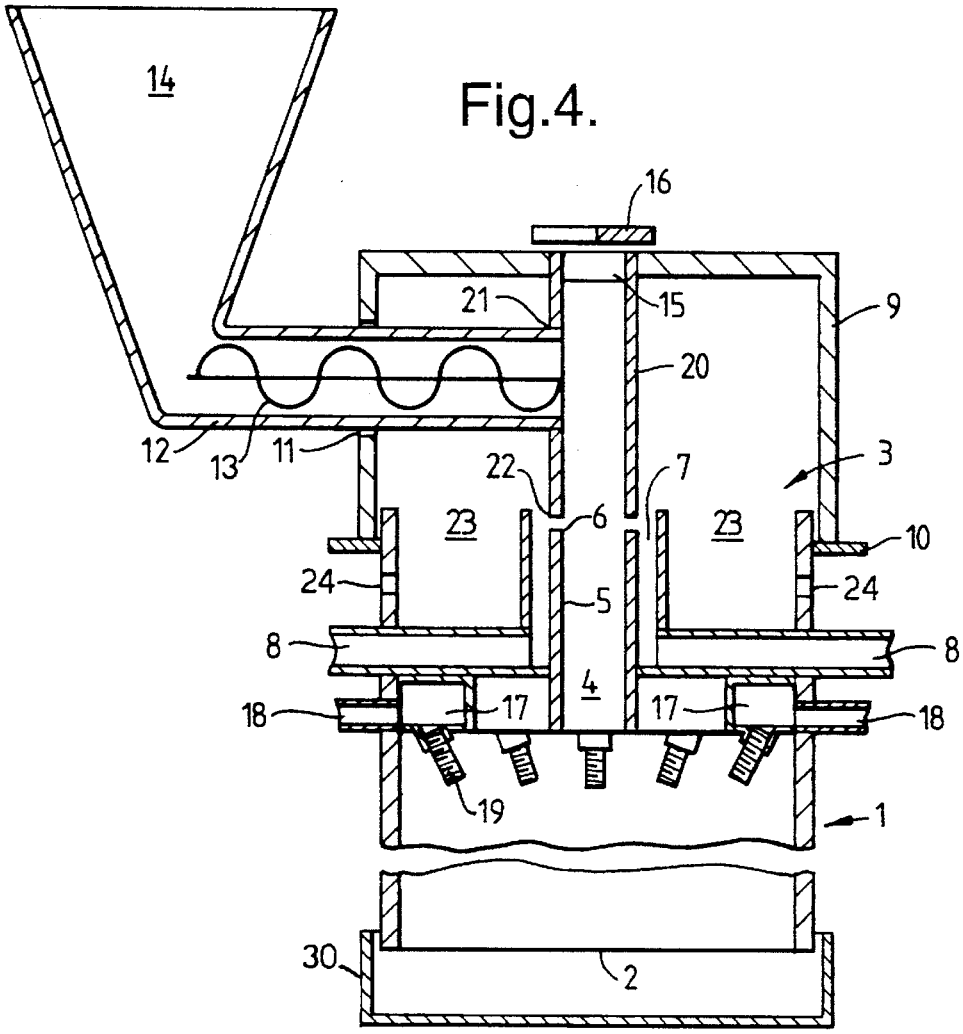
FIG. 4 is a vertical cross-section through a second form of apparatus according to the invention.
Figure 5:
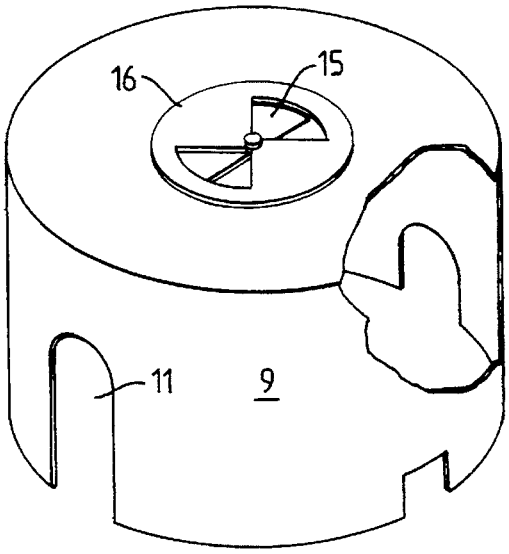
FIG. 5 is a perspective view, part broken away, of the cowl of this second form of apparatus.

A second form of apparatus according to the invention is shown in the vertical cross section in FIG. 4. This second apparatus differs from the first described apparatus firstly in the design of the cowl 9, which encloses the air passage 20 and conveyer feed 12.

The cowl is provided with an aperture 11 to permit the insertion of a conveyor 12 that is typically a screw feed conveyor 13 and that leads from a hopper or other suitable store 14.

An air inlet 15 is provided in the top of the cowl and a rotatable partial closure 16 is mounted, on means not shown, above the opening 15 so that the area of the opening can be adjusted by rotation of the partial closure 16. Thus the air stream through the air passage 20 is controlled by valve 16.

If desired, this second form of apparatus may be provided with holes 24. It may be provided with non-stick material on the interior surfaces of the duct 1, duct inlet 4, jets 19 and side feed T-piece 21 and with heat tape on the external surface of the side feed T-piece 21.

In this second apparatus the air passage 20 terminates at a passage outlet 22 slightly above the weir 6. The passage 20 has substantially the same diameter as the duct inlet 4. With this system also very little powder falls into the annulus 23 around the chamber 7 since the air passage 20 discharges directly into the duct inlet 4.

In a typical process using either of the particular forms of apparatus described above, the duct 1 has a radius of about 12 cm and a length from the top of the duct to the sprays of about 8 cm and from the sprays to the bottom of the duct of about 24 cm. The cowl 9 has a depth of about 5 cm. The diameter of the duct inlet 4 is about 8 cm, and the diameter of the passage 20 is slightly smaller. Eight spray jets 19 (shown as 19A, 19B and 19C in FIG. 1) are arranged at an angle of 10° to the vertical close to the outer diameter of the duct. Four (19A) have a cone angle of 145° while two (19B) have a cone angle of 60° and two (19C) have a cone angle of 90°.

Water soluble cationic polyelectrolyte powder is fed by the screw feed 13 at a rate of 1–3 Kg per minute while water is pumped through the pipes 8 at a rate of about 1 litre per minute and the pipes 18 at a rate of 100–200 litres per minute under a pressure of $1.38\times10^5$ to $4.14\times10^5$ Pa (20–60 psi).

If the second apparatus described above is used, the process is initiated with the aperture 15 fully open but once stabilised conditions have been achieved the closure 16 is adjusted to reduce the air flow through the air inlet 15 to a value at which substantially no fines are blown out of the bottom of the duct but at which uniform wetting of the particles is still achieved. If the first apparatus is used the valve 16 is found to be unnecessary.

A vessel 30 for containing water (not shown) in which the polymeric material can be dissolved or dispersed is positioned beneath the open end of the duct. This vessel may be a tank or a channel through which the dissolution water is continuously flowing.

What is claimed as new and desired to be protected by Letters Patent of the United States is:

We claim:

1. Apparatus for uniformly wetting water-soluble or water-swellable particulate material comprising:

a substantially vertical wetting duct defined by a wall and which has an upper part and a lower end and which is open at its lower end, a duct inlet which is positioned in the upper part of the duct and substantially coaxial with the duct and which has a radius less than the radius of the duct and which is defined by inlet walls which have an upper edge and which extend downwards from the edge, feed means for feeding particulate material to the duct inlet, water spray orifices positioned within the upper part of the duct radially outwards of the duct inlet and arranged to direct sprays of water downwardly in the wetting duct to wet the particulate material, and means for providing a substantially continuous flow of water over the upper edge of the inlet walls and down along substantially the entire exposed inner surface of the inlet walls.

2. Apparatus according to claim 1 in which the means for providing a substantially continuous flow of water comprise an annular vessel surrounding the duct inlet and ducting for continuously supplying water to the annular vessel.

3. Apparatus according to claim 1 for uniformly wetting water soluble or water swellable particulate material which is additionally friable in which the water spray orifices are arranged to direct sprays of water downwardly and substantially across the axis of the duct to disintegrate into substantially independent particles friable particulate material falling into the duct from the duct inlet and to wet the substantially independent particles.

4. Apparatus according to claim 3 including as the feed means conveyer feed means for carrying friable material to a position above the duct inlet and for dropping the material into the duct inlet.

5. Apparatus according to claim 4 including a hopper and wherein the conveyer feed means are positioned to carry friable material from the hopper to a position above the duct inlet and for dropping the material into the duct inlet.

6. Apparatus according to claim 3 including an air feed passage that leads from an air inlet that is exposed to the atmosphere, past a side feed position for receiving a feed of friable material, to a passage outlet that discharges into the duct inlet.

7. Apparatus according to claim 6 in which the passage outlet is of smaller diameter than and is positioned inside the duct inlet.

8. Apparatus according to claim 6 including a hopper for storing particulate material and a conveyer screw feed that leads from the hopper into the side feed position.

9. Apparatus according to claim 1 in which the sprays of water are arranged to provide a substantially uniform distribution of water droplets throughout the wetting duct.

10. Apparatus according to claim 1 comprising a cowl that substantially entirely encloses the top of the duct inlet and that includes air inlet means and an aperture in the cowl to permit the feeding of particulate material to the duct inlet from outside the cowl.

11. Apparatus according to claim 10 in which the air inlet means are substantially coaxial with the duct.

12. Apparatus according to claim 1 in which some of the sprays have a cone angle substantially greater than others of the sprays and the sprays with different cone angles are substantially uniformly distributed around the upper part of the duct.

13. Apparatus according to claim 1 including holes provided in the wall of the wetting duct in its upper part, in which the holes are substantially equally spaced around the wetting duct wall and in which each hole is positioned between two adjacent water spray orifices.

14. Apparatus according to claim 1 additionally comprising a vessel that can contain water and which is positioned beneath the lower end of the duct for receiving wetted particulate material from the duct.

15. A method of uniformly wetting water-soluble or water swellable particulate material comprising:

providing an apparatus comprising;

a substantially vertical wetting duct which has an upper part and a lower end and which is open at its lower end, a duct inlet which is positioned in the upper part of the duct and substantially coaxial with the duct and which has a radius less than the radius of the duct and which is defined by inlet walls which have an upper edge and which extend downwards from the edge, feed means for feeding particulate material to the duct inlet, water spray orifices positioned within the upper part of the duct radially outwards of the duct inlet and arranged to direct sprays of water downwardly in the wetting duct to wet particulate material falling through the duct, means for providing a substantially continuous flow of water over the upper edge of the inlet walls and down along substantially the entire exposed inner surface of the inlet walls, feeding the particulate material to the duct inlet while causing water to flow continuously over the upper edge of the duct inlet walls and down along substantially the entire surface of the duct inlet walls and while directing water sprays from the water spray orifices and thereby wetting the material, and collecting the wetted material in water in a vessel positioned beneath the lower end of the duct.

16. A method according to claim 15 of uniformly wetting water soluble or water swellable particulate material which is additionally friable additionally comprising directing water sprays from the water spray orifices so as to disintegrate the friable material into substantially independent particles and wet the particles.

17. A method according to claim 16 comprising directing water sprays from the water spray orifices so as to provide a substantially uniform distribution of water droplets throughout the wetting duct.

18. A method according to claim 15 comprising directing water sprays from the water spray orifices so as to provide a substantially uniform distribution of water droplets throughout the wetting duct.

* * * * *